US011063329B1

(12) United States Patent
Rmili et al.

(10) Patent No.: US 11,063,329 B1
(45) Date of Patent: Jul. 13, 2021

(54) WAVEGUIDE PHASE SHIFTER INCLUDING A STRAIGHT WAVEGUIDE SECTION AND A CURVED WAVEGUIDE SECTION HAVING VIAS THAT CAN BE FILLED OR EMPTIED

(71) Applicant: King Abdulaziz University, Jeddah (SA)

(72) Inventors: Hatem Rmili, Jeddah (SA); Abdelkhalek Nasri, Jeddah (SA); Raj Mittra, Jeddah (SA); Yusuf Turki, Jeddah (SA)

(73) Assignee: KING ABDULAZIZ UNIVERSITY, Jeddah (SA)

( * ) Notice: Subject to any disclaimer, the term of this patent is extended or adjusted under 35 U.S.C. 154(b) by 0 days.

(21) Appl. No.: 17/065,480

(22) Filed: Oct. 7, 2020

(51) Int. Cl.

| | |
|---|---|
| ***H01P 1/18*** | (2006.01) |
| ***H01P 11/00*** | (2006.01) |
| ***H01P 3/12*** | (2006.01) |
| ***H01Q 3/32*** | (2006.01) |
| ***H01Q 3/36*** | (2006.01) |

(52) U.S. Cl.
CPC ..... *H01P 1/182* (2013.01); *H01P 3/12* (2013.01); *H01P 11/002* (2013.01); *H01Q 3/32* (2013.01); *H01Q 3/36* (2013.01)

(58) Field of Classification Search
CPC .. H01P 1/18; H01P 1/182; H01P 1/022; H01P 1/025; H01P 1/027; H01P 9/006; H01Q 3/30; H01Q 3/32; H01Q 3/34; H01Q 3/26
USPC ..... 333/157
See application file for complete search history.

(56) References Cited

U.S. PATENT DOCUMENTS

| | | | | |
|---|---|---|---|---|
| 3,189,850 | A * | 6/1965 | Walker | H01P 1/025 333/249 |
| 6,313,793 | B1 * | 11/2001 | Brown et al. | H01P 1/182 342/374 |
| 7,038,558 | B2 | 5/2006 | Higgins | |
| 7,283,696 | B2 | 10/2007 | Ticknor et al. | |
| 9,136,579 | B2 | 9/2015 | Lee et al. | |

FOREIGN PATENT DOCUMENTS

| | | | |
|---|---|---|---|
| GB | 2572763 | A | 10/2019 |

OTHER PUBLICATIONS

R. Matra, A. Nasri, D. Oueslati and H. Rmili, "Novel Low-cost Phase Shifters for Millimeter Wave Applications," 2018 IEEE International Symposium on Antennas and Propagation & USNC/URSI National Radio Science Meeting, Boston, MA, 2018, pp. 2127-2128.

* cited by examiner

*Primary Examiner* — Benny T Lee
(74) *Attorney, Agent, or Firm* — W&C IP

(57) ABSTRACT

An exemplary phase shifter is a waveguide with multiple alternate paths for waves. The phase shifter includes at least two alternative paths, one straight and one curved. Rounding, chamfer, or a combination of both are used at the corners where the path transitions from the straight waveguide section to the curved waveguide section or vice versa.

14 Claims, 5 Drawing Sheets

WAVEGUIDE PHASE SHIFTER INCLUDING A STRAIGHT WAVEGUIDE SECTION AND A CURVED WAVEGUIDE SECTION HAVING VIAS THAT CAN BE FILLED OR EMPTIED

FIELD OF THE INVENTION

The invention generally relates to phase shifters and, more particularly, phase shifters in a waveguide form for millimeter wave applications.

BACKGROUND

Phase shifters are components that play a very important role in microwave applications such as phase-array antenna systems, phase-modulation communications systems, and other microwave components. Generally phase shifters are used to introduce differential phase or a phase taper on an array antenna to scan the beam.

An example of a differential phase shifter is the Schiffman phase shifter which uses an edge-coupled strip line section. Another example is a wideband two-layered substrate integrated waveguide (SIW) six-port. This design operates over the V-band and exhibits good performance but a narrow bandwidth. A further type of phase shifter are broadband differential phase shifters using bridged T-type bandpass networks. The network can improve the bandwidth of phase error while keeping good return loss. Yet another phase shifter approach is using multi-layered phase shifters for 60 GHz Wireless Personal Area Network (WPAN) applications. Still another is a mm-wave Micro Electro Mechanical Systems (MEMS) phase shifter based on a slow wave structure. These known phase shifters have the drawback of not delivering a continuously varying phase shift in the field radiated by the antenna element. They can also be expensive to produce.

Other types of phase shifters are stepwise in nature and are typically ferrite-based. These types are typically both costly and highly lossy at millimeter wavelengths.

SUMMARY OF THE INVENTION

One objective of some embodiments is to provide a phase shifter that is a low cost and low loss alternative to existing typically ferrite-based phase shifters.

Another objective is to provide stepwise, continuous, or a combination of stepwise and continuous phase shifting.

Exemplary embodiments may be used in microwave applications such as phase-array antenna systems, phase-modulation communications systems, and other microwave components. Exemplary phase shifters may be used to introduce differential phase or a phase taper on an array antenna to scan the beam. Phase shifters may introduce any value of differential phase to accomplish a desired scan angle. Exemplary embodiments are especially well suited for microwave applications but can be scaled to work with other frequencies.

In some embodiments, phase may be shifted by switching in diodes or varactor diodes. Such embodiments have a speed advantage not offered by mechanical type of phase shifters.

An objective of some embodiments of the present disclosure is to provide 90-degree differential phase shifters in waveguide form for use in many applications. Phase may be changed by adding one or more curved sections to an otherwise straight waveguide to realize the desired scan angle of the array. The use or disuse of any curved section may be controlled by vias. Each curved section may introduce a discrete step in phase. In addition or in the alternative, continuously varying phase shifts may be achieved by using a series of vias arranged in the path of a signal.

An exemplary phase shifter is configured as a waveguide with multiple alternate paths for transmitting waves. The phase shifter includes at least two alternative paths, one straight and one curved. Rounding, chamfers, or a combination of both are used at the corners where the path transitions from the straight waveguide section to the curved waveguide section and vice versa. Using a combination of chamfer and rounded corners at the junctions between the straight section and curved section is especially advantageous. The curved waveguide section effectively increases the total distance a wave (signal) must travel through the waveguide and results in phase shift.

The phase shift is primarily determined by the length of the curved section, but a chamfering and rounding of the transitions between the straight and curved sections are influential in the overall performance, including the bandwidth and exact amount of phase shift. In a straight waveguide there are no reflections as there are when a curved section is inserted into the phase shifter. In a purely straight waveguide, the reflection coefficient S11 is ideally 0 within the operating bandwidth of the guide; hence, the waveguide's bandwidth is not an issue. The addition of the curved section and the control vias allows for stepwise phase shift but carries the drawback of introducing a bandwidth limit. The inclusion of chamfers and/or curvature at the corners where the signal path transitions from the straight waveguide section to the curved waveguide section and vice versa curb the bandwidth limitations while maintaining the desirable amount of phase shift.

DETAILED DESCRIPTION OF THE INVENTION

Figure 1B:
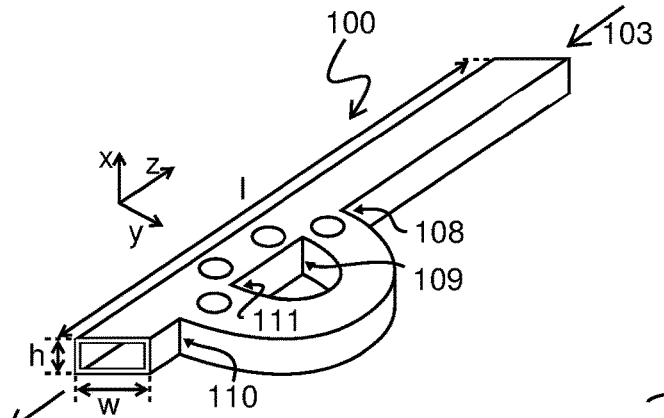
FIG. 1B is a perspective view of the phase shifter of FIG. 1A.
Figure 1A:
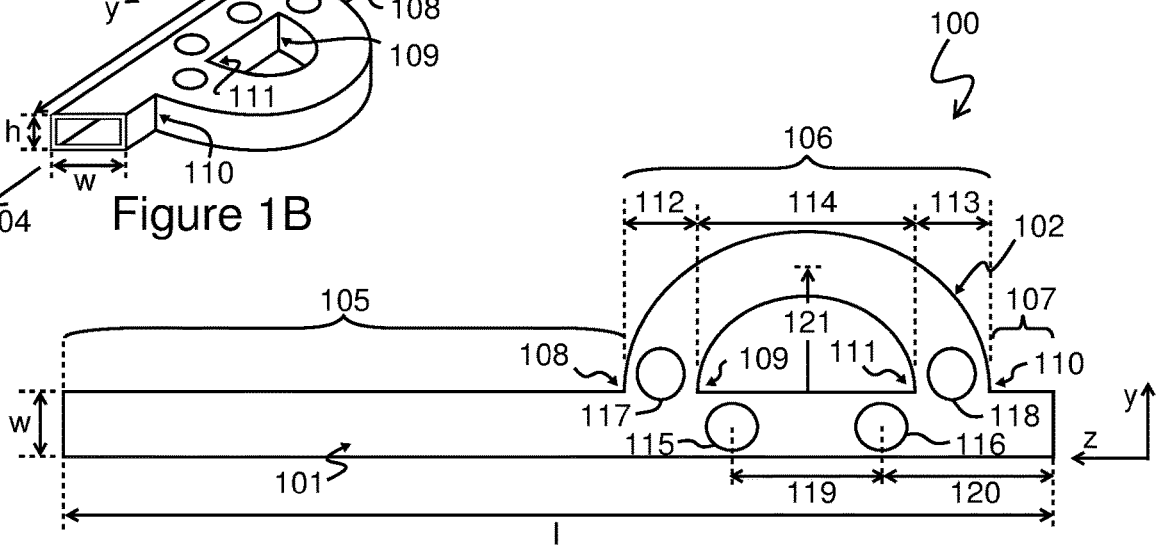
FIG. 1A is a top view of a phase shifter combining straight and curved waveguide sections and capable of phase shifting in the range of 0°-360° in discrete steps.

FIG. 1A shows an exemplary phase shifter 100 configured in a waveguide. FIG. 1B shows the same phase shifter 100 from a perspective view. Note the exact proportions of some features relative others may not be identical between FIGS. 1A and 1B. The phase shifter 100 comprises a straight waveguide section 101 and a curved waveguide section 102 as shown in FIG. 1A. Both the straight section 101 and curved section 102 may be rectangular waveguides. The sections may be filled, in whole or in part, with a dielectric. The exterior of the sections may be any conductor such as metals traditionally used in rectangular waveguides.

The cross-sectional dimensions of the straight section 101 are a width w and a height h (FIG. 1B). The curved section 102 may also have cross-sectional dimensions of width w and a height h. Alternatively, the width of the cross-section of the curved section 102 may differ (be larger or smaller) than the width of the straight section 101. The third dimension of the straight section 101 is length 1. The length of the curved section 102 is dependent on the size of the radius of curvature 121 (FIG. 1A) of the curved section 102 if the curved section is semi-circular. Other curved profiles may be used, however, such as elliptical.

The phase shifter 100 transmits a signal from one end of the straight section 101 to the other end of the straight section 101, as generally indicated by arrows 103 and 104 as shown in FIG. 1B. The phase shifter 100 works in either direction, such that in practice arrows 103 and 104 may be reversed as desired. Either end of the phase shifter 100 can be a wave insertion point and the other end of the phase shifter 100 the phase-shifted wave exit point. Within the z-axis, the phase shifter 100 has three distinct parts. A first part 105 (FIG. 1A) consists of only a subsection of straight waveguide section 101 between a first end of the phase shifter 100 and the start of the curved waveguide section 102. A third part 107 (FIG. 1A) consists of only a subsection of straight waveguide section 101 between a second end of the phase shifter 100 and the end of the curved waveguide section 102. Between the first part 105 and the third part 107 is a second part 106 (FIG. 1A). In the second part 106 the straight waveguide section 101 and the curved waveguide section 102 are arranged in parallel with one another, meaning a signal could pass through one section or the other but not both. The curved waveguide section has a radius of curvature 121. The shape of the curved section need not be limited to circular; elliptic or other shapes can also be used for ease of manufacturing. The location of the curved waveguide section 102 may also be centered anywhere along the z direction. Different embodiments may have longer or shorter waveguide sections 102 than that depicted in the figures in order to produce different amounts of phase shift. While not strictly necessary in all embodiments, it is generally desirable to have the curved waveguide section 102 share the same cross-sectional dimensions as the straight waveguide section 101. The curved waveguide section 102 protrudes from the straight waveguide section 101 in the y-direction (either positive y or negative y direction).

At either end of the second part 106 are the junctions of sections 101 and 102. Each junction includes a pair of corners. The first part 105 and the second part 106 join at corner 108. The second part 106 and the third part 107 join at corner 110. Corner 108 is paired with a corner 109. Corner 110 is paired with a corner 111. Corners 108 and 109 are separated by a distance of 112 (FIG. 1A). Corners 110 and 111 are separated by a distance 113 (FIG. 1A). The corners 109 and 111 are separated by a distance 114 (FIG. 1A). In phase shifter 100 the distances 112 and 113 are both equal to each other and equal to the width of the curved section 102. The width of the curved section 102 is constant for the entirely of the curved section 102 and is equal to the width w of the straight section 101.

As shown in FIG. 1A, the phase shifter 100 comprises a plurality of vias, organized into at least two sets. The first set includes vias 115 and 116 that are positioned in a path of the straight waveguide section 101. Vias 115 and 116 may be spaced apart by a distance 119. Via 116 may be spaced apart from an end of the straight waveguide section 101 by a distance 120. The second set includes vias 117 and 118 which are positioned in a path of the curved waveguide section 102. The vias 115, 116, 117, and 118 are reversibly fillable and emptiable. In addition or in the alternative, the contents of the vias may be reversibly substituted, whereby one content is removed and at the same time or immediately after the emptying an alternate medium is supplied to the space surrounded by the via walls. A suitable filling medium is a liquid or liquidized metal or a metal slug. One fill type may be a conductor, like a metal, whereas another fill type may be a dielectric or an insulator.

The two sets of vias may be configured and operated by a control mechanism to have mutually exclusive combinations of being filled with a conductor or being devoid of filling by a conductor. More specifically, the phase shifter 100 may be configured such that when vias 115 and 116 are filled with a conductor, vias 117 and 118 are not filled with a conductor. Vice versa, when vias 117 and 118 are filled with a conductor, vias 115 and 116 are not filled with a conductor. The vias which are not filled with a conductor may have air, a gas, or substantially nothing inside (e.g., a vacuum). In a waveguide, a metal-filled or metal-lined via or group of vias may serve as the functional equivalent of a metal wall or barrier. A signal inside the waveguide reflects from the "via wall" similar to how the same signal reflects from solid flat walls of a rectangular metal waveguide.

The vias 117 and 118 are positioned substantially within the curved section 102. The vias 117 and 118 may be positioned entirely within the curved section 102. When filled or lined with a conductor, the vias 117 and 118 have the functional effect of creating a wall that is continuous with adjacent walls of the straight waveguide section 101. As a result, a wave transmitted through the phase shifter 100 only travels through the straight waveguide section 101, substantially as though the curved waveguide section 102 does not exist.

The vias 115 and 116 are positioned within the straight section 101 substantially within the second part 106. The vias 115 and 116 may be positioned mainly or entirely within the distance 114 of the z-axis. When filled or lined with a conductor, the vias 115 and 116 have the functional effect of creating walls in the x-y plane (FIG. 1B) which eliminate the signal pathway within the straight section 101 over the distance 114. In this configuration, the only path by which a signal may travel from one end of the straight section 101 to the opposite end of the straight section 101 is through the curved section 102.

The number of vias in some embodiments may differ from the number in the illustrated embodiment of phase shifter 100. For example, the singular via 117 may be substituted with two or more vias which perform the same functional purpose as the singular via 117, namely creating a wall or barrier to signals between corners 108 and 109. The singular via 118 may be substituted with two or more vias which perform the same functional purpose as the singular via 118, namely creating a wall or barrier to signals between corners 110 and 111. The singular via 115 may be substituted with two or more vias which perform the same functional purpose as the singular via 115, namely creating a wall or barrier to signal passage along the straight section 101 substantially corresponding to the z-axis position of corner 109. The singular via 116 may be substituted with two or more vias which perform the same functional purpose as the singular via 116, namely creating a wall or barrier to signal passage along the straight section 101 substantially corresponding to the z-axis position of corner 111.

The phase shifter 100 provides step-wise, incremental phase shift which depends upon the length of the curved section, the exact length of which may be specifically chosen at the time of manufacture for the specific end use intended for the phase shifter 100. Continuously varying phase shift can be achieved by combining the curved phase shifter with straight waveguide phase shifter configuration shown in FIG. 10 (discussed below). Control of whether or not any given signal passing through the phase shifter is or is not phase shifted, and by how much, is based on which of the sets of vias are filled with a conductor (or lined with a conductor) and which are not at the time that the signal in question is transmitted through phase shifter 100.

Figure 2B:
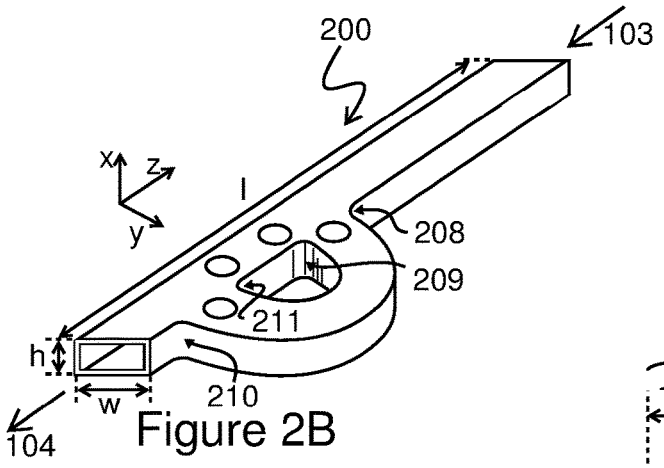
FIG. 2B is a perspective view of the phase shifter of FIG. 2A.
Figure 2A:
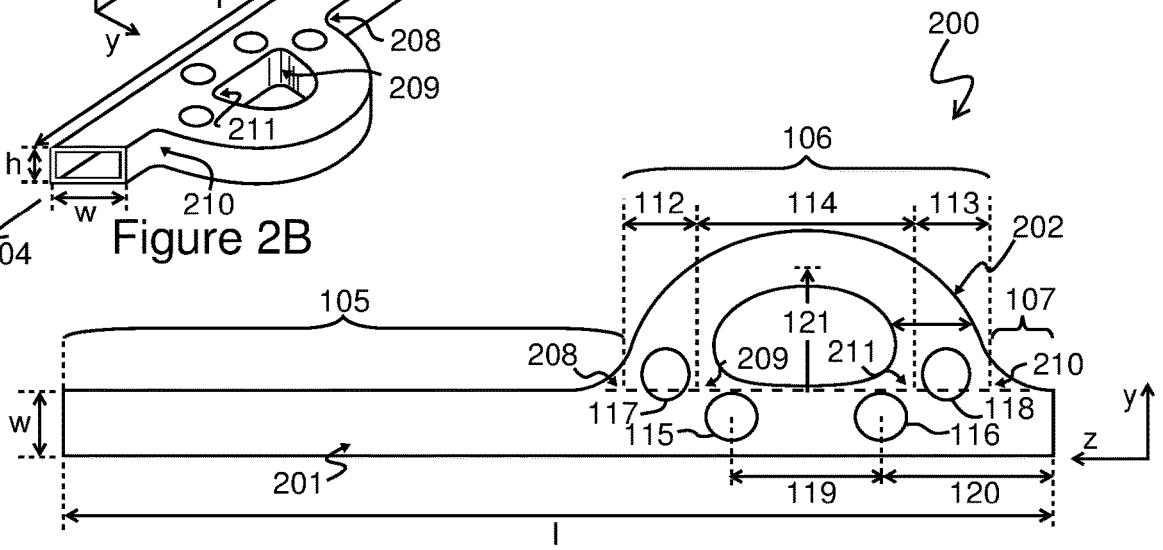
FIG. 2A is a top view of a phase shifter combining straight and curved waveguide sections using rounded corners at the section junctions.

FIG. 2A shows a phase shifter 200 configured as a waveguide. FIG. 2B shows the same phase shifter 200 from a perspective view. Note the exact proportions of some features relative others may not be identical between FIGS. 2A and 2B. Identical or substantially identical features with respect to phase shifter 100 have the same numerical identifiers and description thereof may be omitted. The phase shifter 200 has a straight waveguide section 201 and a curved waveguide section 202 as shown in FIG. 2A. The straight waveguide section 201 has a width w, a length 1, and a height h (FIG. 2B). Within the z-axis the phase shifter 200 has three distinguishable parts, a first part 105, a second part 106, and a third part 107 as shown in FIG. 2A. The second part 106 consists of distances 112, 114, and 113 in the z-direction as shown in FIG. 2A. To facilitate comparison among embodiments, distances 112, 114, and 113 are identical for both exemplary phase shifters 100 and 200, although in actual practice embodiments may employ different dimensions. In phase shifter 200 the distances 112 and 113 are both equal to each other.

At either end of the second part 106 are the junctions of sections 201 and 202. Each junction includes a pair of corners. The first part 105 and the second part 106 join at corner 208. The second part 106 and the third part 107 join at corner 210. Corner 208 is paired with a corner 209. Corner 210 is paired with a corner 211. In contrast to the sharp corners of phase shifter 100, the corners where straight and curved sections 201 and 202 meet are rounded. The rounded corners may alternatively be referred to as "radiused", "filleted", or "curved" corners. The lead arrows for corners 208, 209, 210, and 211, together with broken lines, indicate the geometric points in the drawing from which the radii of curvature may be measured as shown in FIG. 2A. For purposes of this disclosure, radii of curvature less than 0.05 mm are considered "sharp" corners not "rounded." Conversely, a "rounded" corner has a radius of curvature of 0.05 mm or above, in some embodiments 0.1 mm or above, and in some embodiment 1.0 mm or above. Rounded corners are advantageous over sharp corners because rounded corners reduce undesired reflection that can occur at sharp corners. The exact radius of curvature employed for rounding corners 208, 209, 210, and 211 can vary among embodiments.

As shown in FIG. 2A, the phase shifter 200 comprises a plurality of vias, organized into at least two sets. The first set includes vias 115 and 116 which are positioned in a path of the straight waveguide section 201. Vias 115 and 116 may be spaced apart by a distance 119. Via 116 may be spaced apart from an end of the straight waveguide section 201 by a distance 120. The second set includes vias 117 and 118 which are positioned in a path of the curved waveguide section 202. The vias 114, 116, 117, and 118 may be substantially configured and operated as described above with respect to phase shifter 100.

Figure 3B:
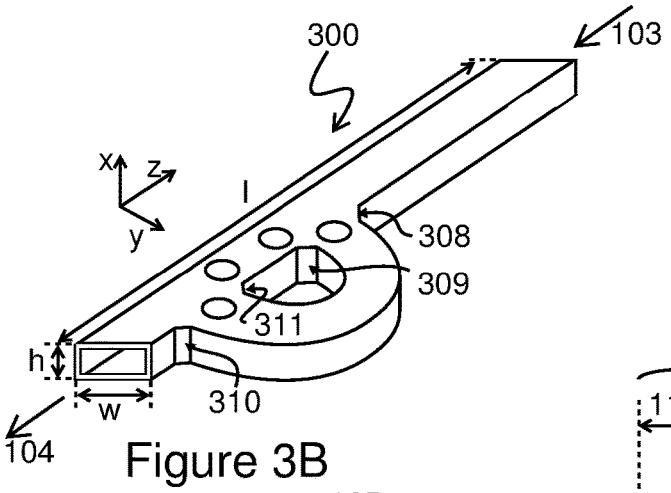
FIG. 3B is a perspective view of the phase shifter of FIG. 3A.
Figure 3A:
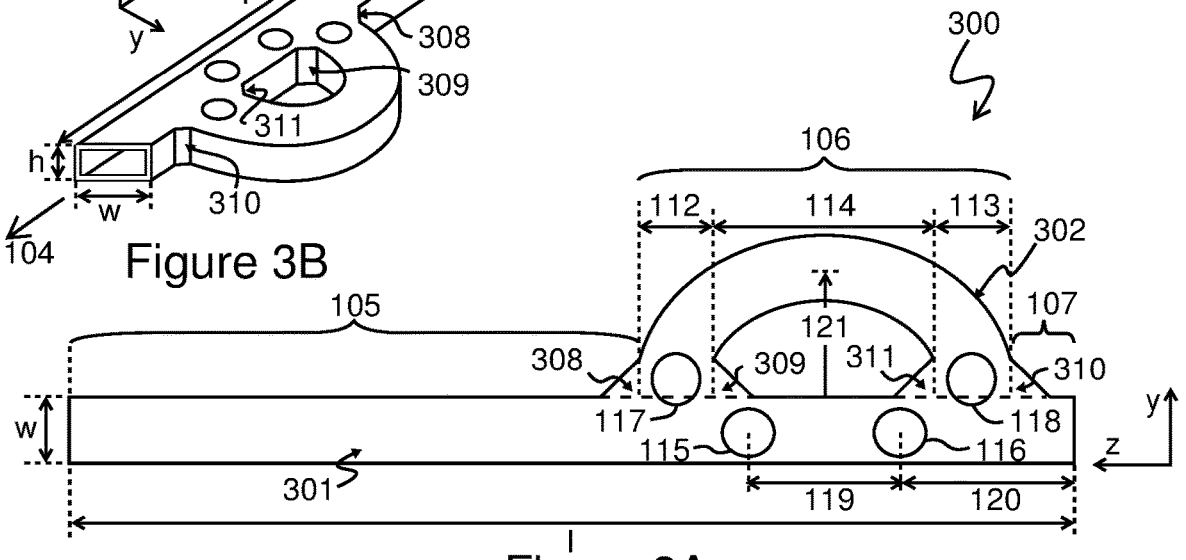
FIG. 3A is a top view of a phase shifter combining straight and curved waveguide sections using chamfered corners at the section junctions.

FIG. 3A shows a phase shifter 300. FIG. 3B shows the same phase shifter 300 from a perspective view. Note the exact proportions of some features relative others may not be identical between FIGS. 3A and 3B. Identical or substantially identical features with respect to phase shifter 100 have the same numerical identifiers and description thereof may be omitted.

The phase shifter 300 has a straight waveguide section 301 and a curved waveguide section 302 as shown in FIG. 3A. The straight waveguide section 301 has a width w, a length 1, and a height h (FIG. 3B). Within the z-axis the phase shifter 300 has three distinguishable parts, a first part 105, a second part 106, and a third part 107 as shown in FIG. 3A. The second part 106 consists of distances 112, 114, and 113 in the z-direction as shown in FIG. 3A. To facilitate comparison among embodiments, distances 112, 114, and 113 are identical for both exemplary phase shifters 100 and 300, although in actual practice embodiments may employ different dimensions. In phase shifter 300 the distances 112 and 113 are both equal to each other.

Figure 7:
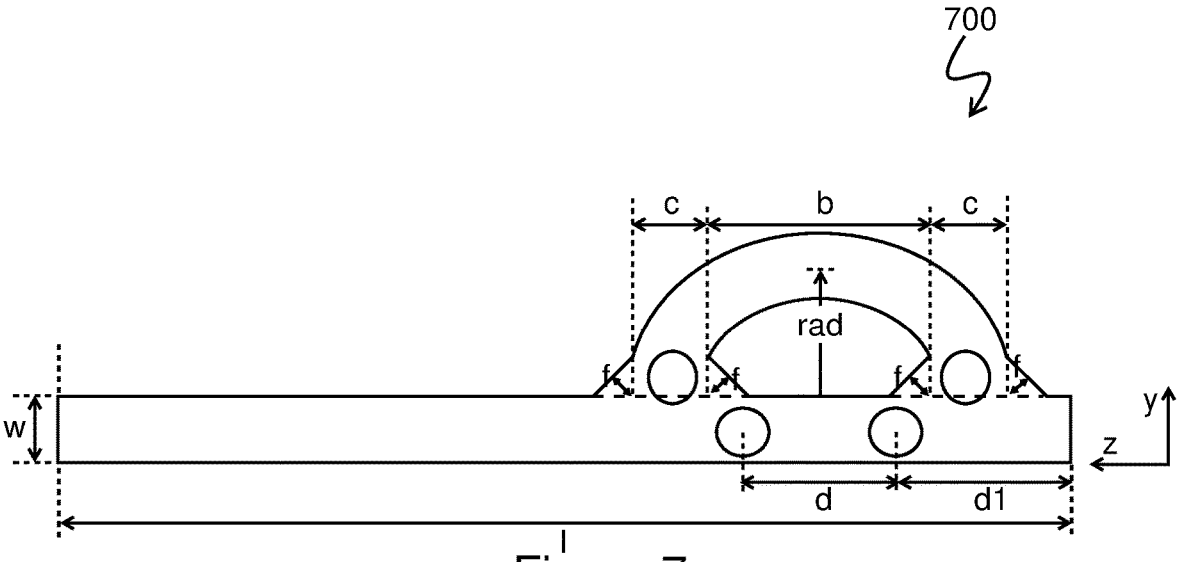
FIG. 7 is a phase shifter according to Example 3.

At either end of the second part 106 are the junctions of sections 301 and 302. Each junction includes a pair of corners. The first part 105 and the second part 106 join at corner 308. The second part 106 and the third part 107 join at corner 310. Corner 308 is paired with a corner 309. Corner 310 is paired with a corner 311. In contrast to the sharp corners of phase shifter 100, the corners where straight and curved sections 301 and 302 meet are chamfered. The chamfered corners may alternatively be referred to as angled corners. The lead arrows for corners 308, 309, 310, and 311, together with broken lines, indicate the geometric points in the drawing from which the chamfers may be measured as shown in FIG. 3A. The chamfers in the exemplary phase shifter 300 each have a width f, e.g. 1.7 mm in the Examples below (see FIG. 7 for label 'f'), and an angle, e.g. 45° in the Examples below, as shown in FIG. 7. The exact chamfer employed for corners 308, 309, 310, and 311 may vary according to different embodiments depending on the signal for which the phase shifter 300 is intended and the amount of phase shift desired. Generally, a chamfered corner configuration has less reflection and slightly higher bandwidth than the design with sharp corners, all other device dimensions being substantially unchanged.

As shown in FIG. 3A, the phase shifter 300 comprises a plurality of vias, organized into at least two sets. The first set includes vias 115 and 116 which are positioned in a path of the straight waveguide section 301. Vias 115 and 116 may be spaced apart by a distance 119. Via 116 may be spaced apart from an end of the straight waveguide section 301 by a distance 120. The second set includes vias 117 and 118 which are positioned in a path of the curved waveguide section 302. The vias 114, 116, 117, and 118 may be substantially configured and operated as described above with respect to phase shifter 100.

Figure 4B:
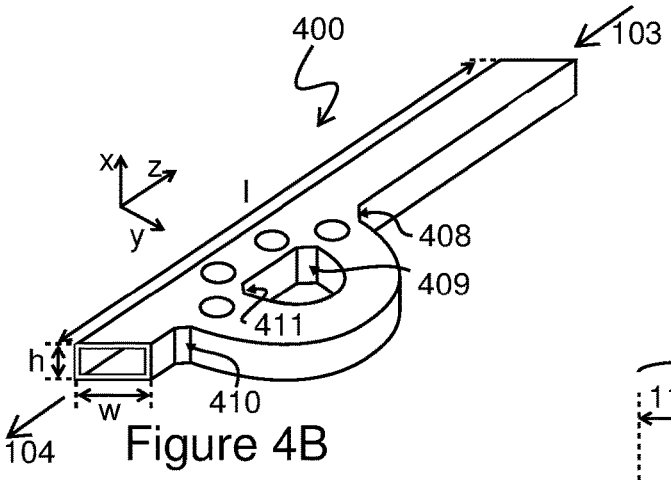
FIG. 4B is a perspective view of the phase shifter of FIG. 4A.
Figure 4C:
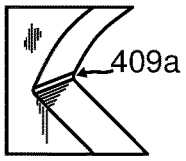
FIG. 4C is an enlarged perspective view of a subcorner showing rounding at the edge of the chamfer.
Figure 4A:
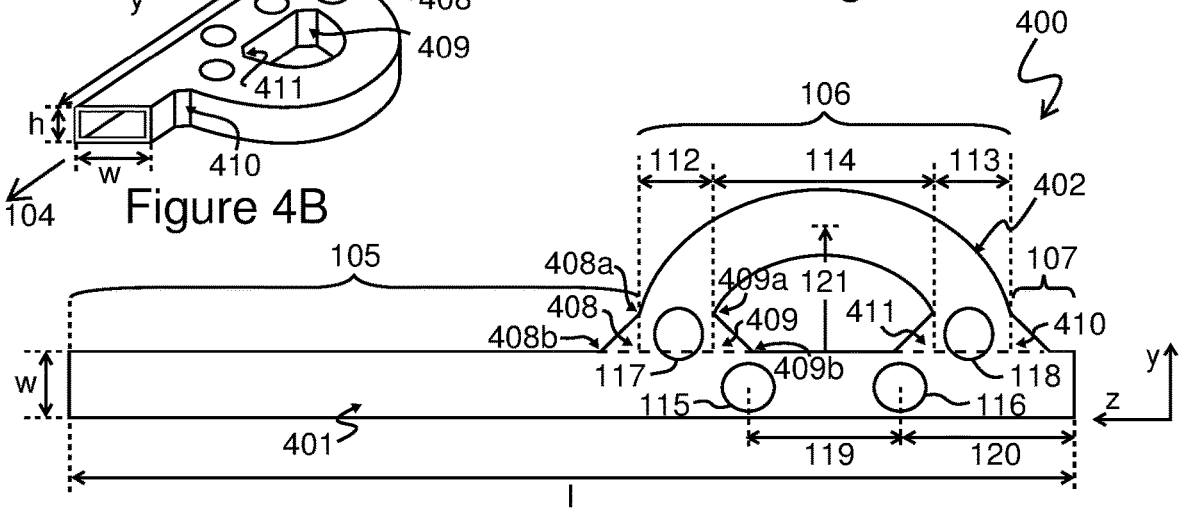
FIG. 4A is a top view of a phase shifter combining straight and curved waveguide sections using a combination of rounded and chamfered corners at the section junctions.

FIG. 4A shows a phase shifter 400. FIG. 4B shows the same phase shifter 400 from a perspective view. Note the exact proportions of some features relative others may not be identical between FIGS. 4A and 4B. Identical or substantially identical features with respect to phase shifter 100 have the same numerical identifiers and description thereof may be omitted. The phase shifter 400 has a straight waveguide section 401 and a curved waveguide section 402 as shown in FIG. 4A. The straight waveguide section 401 has a width w, a length 1, and a height h (FIG. 4B). Within the z-axis the phase shifter 400 has three distinguishable parts, a first part 105, a second part 106, and a third part 107 as shown in FIG. 4A. The second part 106 consists of distances 112, 114, and 113 in the z-direction as shown in FIG. 4A. To facilitate comparison distances 112, 114, and 113 are identical for both exemplary phase shifters 100 and 400, although in actual practice embodiments may employ different dimensions. In phase shifter 400 the distances 112 and 113 are both equal to each other.

At either end of the second part 106 are the junctions of sections 401 and 402. Each junction includes a pair of corners. The first part 105 and the second part 106 join at corner 408. The second part 106 and the third part 107 join at corner 410. Corner 408 is paired with a corner 409. Corner 410 is paired with a corner 411. In contrast to the sharp corners of phase shifter 100, the corners where straight and curved sections 401 and 402 meet are a combination of chamfer and curve. By definition a "chamfer" comprises a flat, planar surface. At either end of this surface is what this disclosure will refer to as a subcorner. In FIG. 4A, corner 408 has subcorners 408*a* and 408*b*. Corner 409 has subcorners 409*a* and 409*b*. Corners 410 and 411 also have subcorners (unlabeled to avoid crowding the figure). Whereas the subcorners in phase shifter 300 were sharp, the subcorners 408*a*, 408*b*, 409*a*, 409*b*, etc. are rounded in phase shifter 400. The rounding may be small, e.g. a radius of curvature of 0.1 mm, with a result that seeing the rounding in FIG. 4A or FIG. 4B is not possible. FIG. 4C is an enlarged perspective view of subcorner 409*a* showing the rounding at the edge of the chamfer's flat plane. In phase shifter 400 all of the chamfered corners have rounded subcorners.

The lead arrows for corners 408, 409, 410, and 411, together with broken lines, indicate the geometric points in the drawing from which the chamfers may be measured as shown in FIG. 4A. The exact chamfer dimensions and radii of curvature employed for corners 408, 409, 410, and 411 may vary according to different embodiments depending on the signal for which the phase shifter 400 is intended and the amount of phase shift desired.

As shown in FIG. 4A, the phase shifter 400 comprises a plurality of vias, organized into at least two sets. The first set includes vias 115 and 116 which are positioned in a path of the straight waveguide section 401. Vias 115 and 116 may be spaced apart by a distance 119. Via 116 may be spaced apart from an end of the straight waveguide section 401 by a distance 120. The second set includes vias 117 and 118 which are positioned in a path of the curved waveguide section 402. The vias 114, 116, 117, and 118 may be substantially configured and operated as described above with respect to phase shifter 100.

Using a combination of chamfer and rounded corners at the junctions between the straight section 401 and curved section 402 is especially advantageous. The greater the chamfer aspect of the corners, the greater the resulting bandwidth. Balancing the chamfer and curvature of the corners provides the benefits of both configurations while minimizing their respective drawbacks. The result is a phase shifter 400 which achieves both a desired phase shift, e.g. 90°, while simultaneously achieving acceptable bandwidth, e.g. 18.5 GHz.

Figure 9:
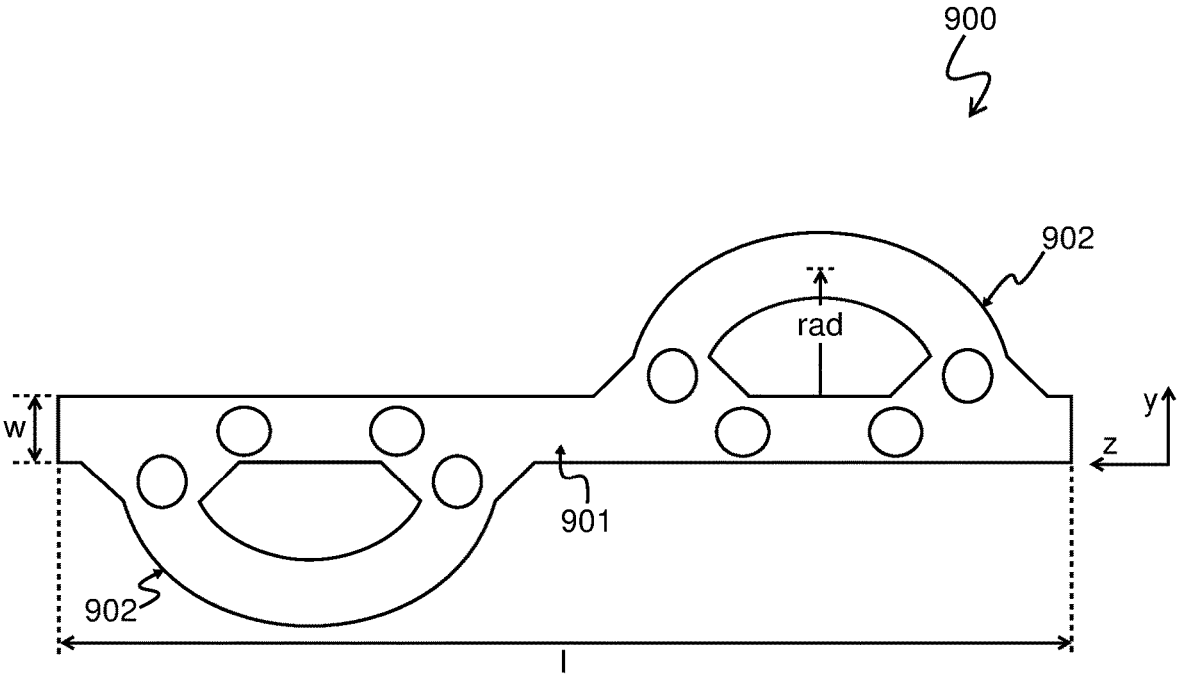
FIG. 9 is a phase shifter with multiple curved waveguide sections arranged at different positions along the straight waveguide section.

FIG. 9 shows a phase shifter 900 that includes a straight waveguide section 901 and a plurality of curved waveguide sections 902. The y-direction and z-direction are labeled. The width is w. The length is 1 Rad is a radius of the curved section. Multiple curved waveguide sections 902 can be used to achieve different combinations of incremental phase shifts; hence the design is flexible. The use of any curved section 902 may be controlled independent of other curved sections 902 by altogether separate sets of vias. The dimensions of the curved sections, in particular the total path length introduced by the curved section, may differ among the curved waveguide sections or be the same among some or all of the curved waveguide sections. The width is w.

Figure 10:
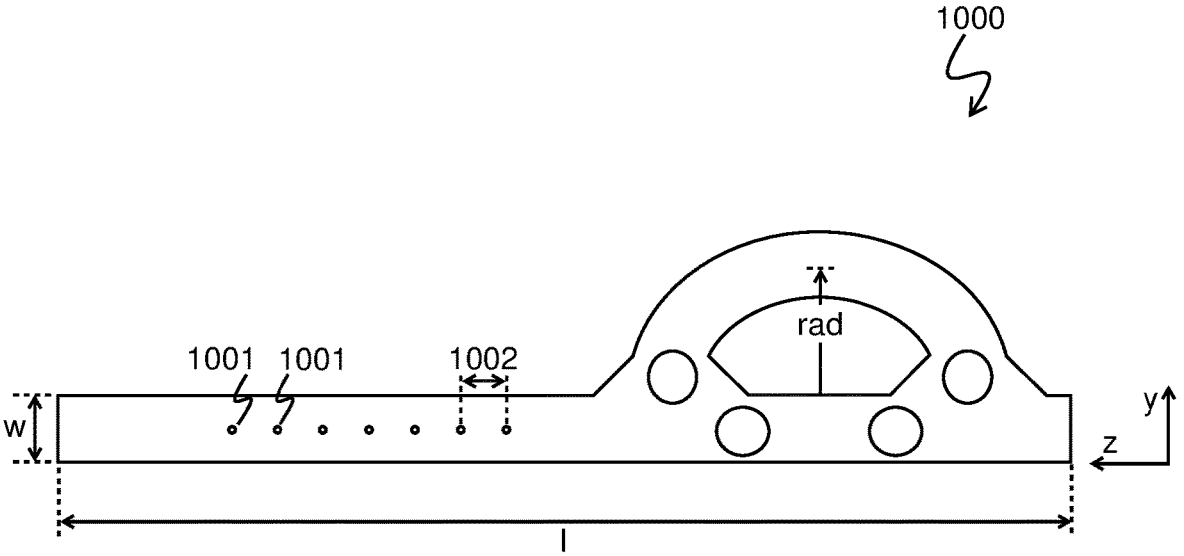
FIG. 10 is a phase shifter that allows for continuously varying phase shift and stepwise phase shift.

FIG. 10 is yet another embodiment of an exemplary phase shifter. The y-direction and z-direction are labeled. The width is w. Rad is a radius of the curved section. Phase shifter 1000 combines features of above-described embodiments with a further feature of a series of vias 1001 separated from one another by a distance 1002. The vias 1001 are centered in a row along a center axis of the straight waveguide section and extend through the straight waveguide section in the z-direction. FIG. 10 shows seven vias 1001, but the exact number of vias may be varied. As with vias described above, the vias may be selectively filled or emptied of different contents to switch the vias between two states. In one state the via affects waves in the straight waveguide section, and in the other state the via does not substantially affect waves in the straight waveguide section. At any given time all of the vias 1001 may be filled or lined with a conductor, at other times all of the vias 1001 may be devoid of a conductor and/or filled with a non-conductor, and at still other times a portion of the vias 1001 may be filled with a conductor and the remainder of the vias 1001 devoid of conductor. In this way the number of vias 1001 affecting a wave passing through the phase shifter 1000 may be varied. How many vias are filled with a conductor at any given time may be regulated and controlled by a controller (not depicted) to change the amount of resulting phase shift. Activating switches embedded in the vias changes the propagation constant of the waveguide locally, and thereby introduces a phase shift in the wave traversing the waveguide where the via is located.

EXAMPLES

In the following examples, data was produced for simulated phase shifters/waveguides using commercial software called Ansys/HFSS. The tables include measures of S-parameters S11 and S21, defined according to their customary meaning in the microwaves field. Except in instances where an example explicitly specifies a different dimensional measure, the dimensions used for the modeling are given by Table 1.

Figure 5:
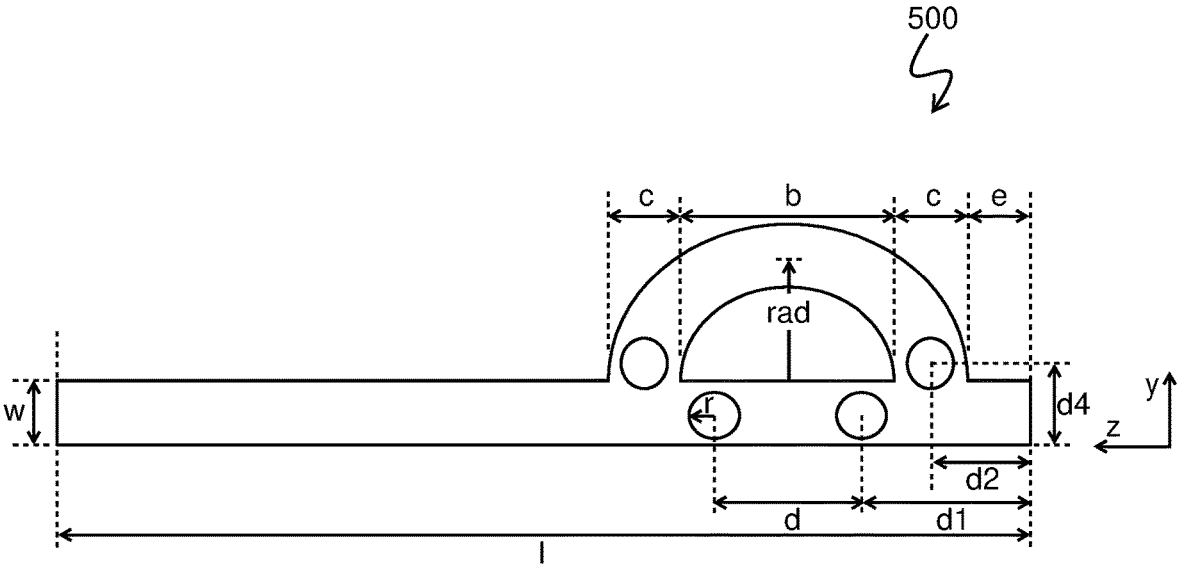
FIG. 5 is a phase shifter according to Example 1.

Example 1. Incremental Phase Shifter Using a Combination of Straight Waveguide and Curved Waveguide This example demonstrates step-wise phase shifts in increments of 90° and their multiples. FIG. 5 shows the configuration of the phase shifter 500 comprising a combination of straight and curved waveguide. The phase shifter 500 shares the same general features of phase shifter 100 (FIG. 1A, FIG. 1B). The y-direction and z-direction are labeled. For the phase shifter 500, l and w are the length and width of the straight waveguide, respectively as shown in FIGS. 5-8. Rad and c are the average radius and the width of the curved section, respectively, and r is the radius of a via. All of the vias had the same radius r. The height h (FIG. 1B) of the waveguide section is 1.5 mm. Other relevant dimensions to the example are shown in Table 1. All measures have units of millimeters (mm). By controlling the positions of the two vias using liquid metal, a differential phase close to 90° was achieved, as indicated by Table 2.

TABLE 1

Dimensions of straight and curved waveguide sections

| l | w | h | d | dl | b | c | e | r | rad | d2 | d4 |
|---|---|---|---|---|---|---|---|---|---|---|---|
| 40 | 3 | 1.5 | 6.1 | 6.95 | 8.8 | 3 | 2.6 | 1.1 | 6 | 4.1 | 3.92 |

TABLE 2

Differential Phase

| | S21(dB) | S11(dB) | S21(°) | Differential phase Δ = Q1-Q2 |
|---|---|---|---|---|
| Vias in curve section | −0.23 | −15.4 | Q1 = 67.75 | |
| Vias in straight section | −0.16 | −31.4 | Q2 = 22.75 | −90.51 |

Figure 6:
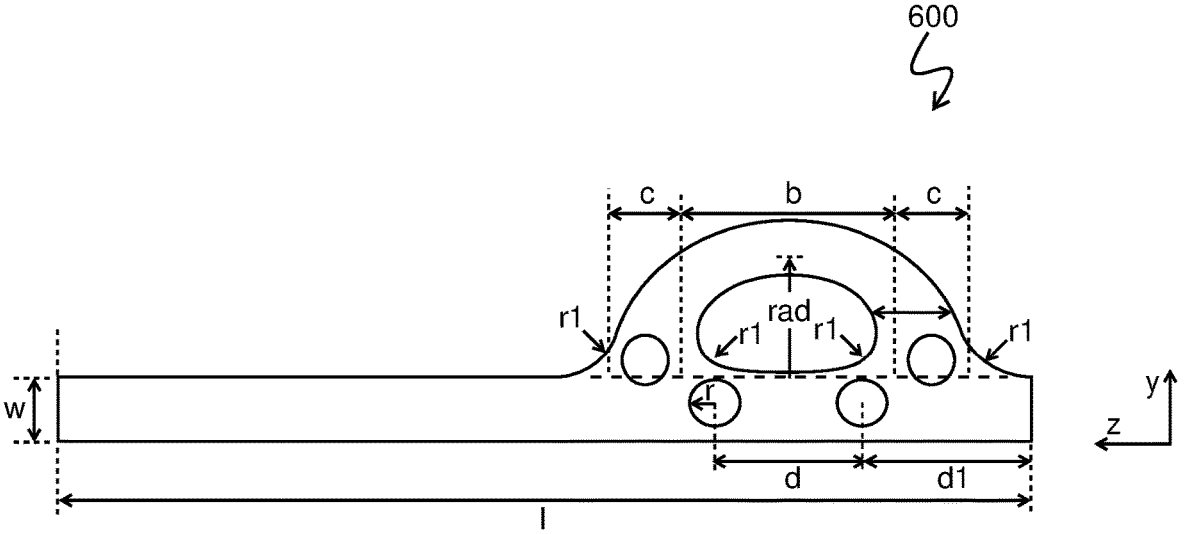
FIG. 6 is a phase shifter according to Example 2.

Example 2. Phase Shifter Bandwidth Using a Combination of Straight and Curved Waveguide Sections with Rounded Corners This example shows configuration aspects which allow for wide band differential phase shifter. FIG. 6 shows a phase shifter 600 comprising a combination of straight and curved waveguide sections with general features corresponding to the phase shifter 200 (FIG. 2A, FIG. 2B). The y-direction and z-direction are labeled. The dimensions for the example are indicated in Table 3. The height h (FIG. 2B) is 1.5 mm. Example 2 included rounding of all corners between the straight and curved waveguides as shown in FIG. 6. The radius r1 of the rounded corner is 1.7 mm. The value of r1 was optimized to improve the S11 bandwidth, and then the radius rad was selected to achieve a predetermined differential phase desired.

As shown in Table 4, including the rounding of the corners where the straight and curved waveguide sections, the phase shifter 400 resulted in a phase shift of nearly 90° but a narrower bandwidth equal to 4.41 GHz.

TABLE 3

Dimensions of the Straight and Curved Waveguide Sections

| l | w | h | d | dl | b | c | r | rad |
|---|---|---|---|---|---|---|---|---|
| 40 mm | 3 mm | 1.5 mm | 6.1 mm | 6.95 mm | 8.8 mm | 3 mm | 1.1 mm | 6 mm |

TABLE 4

Differential Phase and Bandwidth after rounding the corners

| | S21 (dB) | S11 (dB) | S21 (°) | Dif. ph. Δ = Q1 − Q2 | Dif. ph. Δ = Q1 − Q2 + 360 | S11 Bandwidth (GHz) |
|---|---|---|---|---|---|---|
| Ref: straight waveguide | −0.12 | −64.03 | Q1 = −155.69 | | | |
| rad = 6 mm | −0.31 | −13.7 | Q2 = 92.37 | −248.06 | Δ = −68.06 | 8.84 |
| rad = 5.9 mm | −0.49 | −10.94 | Q2 = 116.55 | −272.24 | Δ = −92.24 | 4.41 |

Example 3. Phase Shifter Bandwidth Using a Combination of Straight and Curved Waveguide Sections with Chamfered Corners In this example phase shift is achieved with a phase shifter 700 as shown in FIG. 7. The y-direction and z-direction are labeled. This embodiment chamfers all corners between the straight and curved waveguides with general features corresponding to phase shifter 300 (FIG. 3A, FIG. 3B). The width of the chamfered corner is f and is equal to 1.7 mm and the angle 45° for all four corners.

Simulated results shown in Table 5 demonstrate that the bandwidth increases to 14.05 GHz by chamfering the corners but the phase shift was below 90 degrees which is often the most desired value. Besides the specific dimensions of the chamfer, the remaining dimensions are the same as given in Table 1 above.

TABLE 5

| Differential phase after chamfering the corners | | | | | | |
|---|---|---|---|---|---|---|
| | S21 (dB) | S11 (dB) | S21 (°) | Dif. ph. Δ = Q1 − Q2 | Dif. ph. Δ = Q1 − Q2 + 360 | S11 Bandwidth (GHz) |
| Ref: straight waveguide | −0.12 | −64.03 | Q1 = −155.69 | | | |
| rad = 6 mm | −0.22 | −16.61 | Q2 = 83.71 | −239.4 | Δ = −59.4 | 14.05 |

Figure 8:
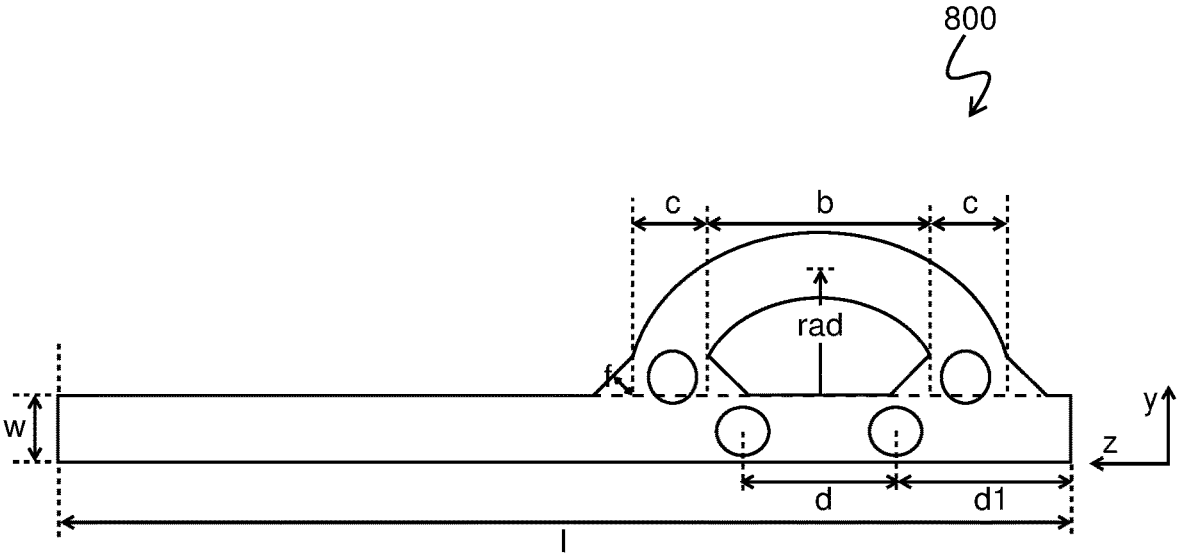
FIG. 8 is a phase shifter according to Example 4.

Example 4. Increasing Phase Shifter Bandwidth Using a Combination of Straight and Curved Waveguide Sections with Chamfered and Rounded Corners Rounding the corners between straight and curved waveguide sections, as in Example 2, resulted in good phase shift but relatively narrow bandwidth. Chamfering the corners between straight and curved waveguide sections, as in Example 3, resulted in wide bandwidth but reduced phase shift. Example 4 tests a waveguide 800 (FIG. 8) which combines both approaches of rounding and chamfering so as to achieve phase shift of approximating 90° with wide bandwidth. Phase shifter 800 has an r1=0.1 mm as the radius of the round (FIG. 6) and f=1.7 mm as the width of chamfer (FIG. 8). The y-direction and z-direction are labeled. With the exception of the chamfers and the rounding dimensions, the phase shifter dimensions are those given in Table 1 above. Table 6 shows that while chamfering and rounding the corners of the straight and curved waveguides the phase shift reaches nearly 90° and becomes a wide bandwidth about 18.5 GHz.

TABLE 6

| Differential phase after chamfering and rounding the corners. | | | | | | |
|---|---|---|---|---|---|---|
| | S21 (dB) | S11 (dB) | S21 (°) | Dif. ph. Δ = Q1 − Q2 | Dif. ph. Δ = Q1 − Q2 + 360 | S11 Bandwidth (GHz) |
| Ref: straight waveguide | −0.12 | −64.03 | Q1 = −155.69 | | | |
| rad = 6 mm | −0.23 | −16.56 | Q2 = −95.69 | −60 | Δ = −60 | 14.68 |
| rad = 5.7 mm | −0.13 | −49.62 | Q2 = −64.9 | −90.79 | Δ = −90.79 | 18.5 |

Example 5. Incremental Phase Shift Based on Variable Number of Vias

This example shows the results of a straight waveguide with vias along a center axis and spaced apart by a distance of 2 mm, consistent with the description of vias 1001 in FIG. 10. Simulated results demonstrated that the phase of a wave transmitted through the waveguide was shifted by varying the effective number of vias. A full 90° phase shift was achieved with 8 vias.

TABLE 7

| Variation of the Differential Phase with Increasing Number of Vias | | | | | |
|---|---|---|---|---|---|
| | S21(dB) | S11(dB) | S21(°) | Differential phase Δ = Q1-Q2 | Differential phase Δ = Q1-Q2 + 360 |
| Ref: straight waveguide | −0.12 | −60.82 | Q1 = −155.57 | | |

TABLE 7-continued

| Variation of the Differential Phase with Increasing Number of Vias | | | | | |
|---|---|---|---|---|---|
| | S21(dB) | S11(dB) | S21(°) | Differential phase Δ = Q1-Q2 | Differential phase Δ = Q1-Q2 + 360 |
| 1 via | −0.34 | −13.2 | Q2 = −167.68 | 12.11 | Δ = 12.11 |
| 2 vias | −0.12 | −40.26 | Q2 = −179.05 | 23.48 | Δ = 23.48 |
| 3 vias | −0.3 | −14 | Q2 = 169.11 | −324.68 | Δ = 35.32 |
| 4 vias | −0.13 | −31.13 | Q2 = 157.18 | −321.75 | Δ = 47.25 |
| 5 vias | −0.31 | −13.89 | Q2 = 146.87 | −302.44 | Δ = 57.56 |
| 6 vias | −0.13 | −32.89 | Q2 = 126.12 | −281.69 | Δ = 78.31 |
| 7 vias | −0.3 | −14.14 | Q2 = 124.26 | −279.83 | Δ = 80.17 |
| 8 vias | −0.13 | −31.25 | Q2 = 113.36 | −268.93 | Δ = 91.07 |

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of a "negative" limitation or use of such exclusive terminology as "solely," "only" and the like in connection with the recitation of claim elements.

While exemplary embodiments of the present invention have been disclosed herein, one skilled in the art will recognize that various changes and modifications may be made without departing from the scope of the invention as defined by the following claims.

ACKNOWLEDGMENT

This project was funded by Science and Technology Unit—King Abdulaziz University—Kingdom of Saudi Arabia—award number (UE-41-103).

What is claimed is:

1. A phase shifter for shifting the phase of a signal transmitted therethrough, comprising:

a straight waveguide section;

at least one curved waveguide section joined at multiple different locations with the straight waveguide section;

a first set of vias positioned in a signal path through the straight waveguide section;

a second set of vias positioned in a signal path through the curved waveguide section; and a combination of rounded and/or chamfered corners where the straight and curved waveguide sections join to each other.

2. The phase shifter of claim 1, wherein the signal path through the at least one curved waveguide section is arranged as an alternate signal path to the signal path through the straight waveguide section.

3. The phase shifter of claim 1, wherein the corners joining the straight and curved waveguide sections have a radius of curvature of 0.05 mm or greater.

4. The phase shifter of claim 1, further comprising a third set of vias aligned along a center axis of the straight waveguide section.

5. The phase shifter of claim 4, wherein the first and second sets of vias are configured to be filled or emptied of a conductor to control a path for the signal transmitted through the phase shifter, and wherein the third set of vias are configured to be filled or emptied of a conductor to vary an amount of phase shift caused to the signal transmitted through the phase shifter.

6. The phase shifter of claim 1, wherein the first and second sets of vias are configured to be filled or emptied of a conductor to control shifting the phase of the signal transmitted through the phase shifter.

7. The phase shifter of claim 6, wherein the first set of vias are configured to be filled while the second set of vias are empty to produce the signal path through the curved waveguide section, and wherein the second set of vias are configured to be filled while the first set of vias are empty to produce the signal path through the straight waveguide section.

8. The phase shifter of claim 1, further comprising one or more additional curved waveguide sections in addition to the at least one curved waveguide section.

9. The phase shifter of claim 8, wherein each curved waveguide section is usable to produce a different amount of phase shift.

10. A method of manufacturing a phase shifter to produce a predetermined amount of phase shift for a bandwidth above a predetermined threshold, comprising combining at multiple different locations a straight waveguide section and at least one curved waveguide section into a single waveguide having only one signal input port and only one signal output port;

providing a first set of vias positioned in a signal path through the straight waveguide section and a second set of vias positioned in a signal path through the curved waveguide section; and providing chamfers and rounding at corners joining the straight waveguide section and the at least one curved waveguide section, sizes of the chamfers and rounding at the corners being selected to satisfy the predetermined amount of phase shift and the predetermined threshold for bandwidth.

11. A method of phase shifting a signal transmitted through a phase shifter, comprising:

filling in a reversible manner or lining with a conductor in a reversible manner first vias which lie in a straight path through a straight waveguide to deviate for a first time the signal from the straight path through the straight waveguide into a curved path through a curved waveguide, wherein the curved path has a first end and a second end, wherein the straight waveguide and the curved waveguide join at corners, wherein the corners joining the straight waveguide and the curved waveguide are a combination of rounded and/or chamfered corners, wherein the curved path joins the straight waveguide at both the first end and the second end.

12. The method of claim 11 wherein the rounded and/or chamfered corners joining the straight and curved waveguide sections have a radius of curvature of 0.05 mm or greater.

13. The method of claim 11, further comprising filling in a reversible manner or lining in a reversible manner second vias which lie in a row in the straight path of the straight waveguide, the number of second vias being filled or lined with conductor in the reversible manner selected based on a predetermined amount of phase shift.

14. The method of claim 13, further comprising filling in a reversible manner or lining with a conductor in a reversible manner third vias which lie in the straight path through the straight waveguide to deviate the signal from the straight path for a second time into another curved path of another curved waveguide, wherein the another curved path joins the straight waveguide at least one end of the another curved waveguide.

* * * * *